United States Patent [19]

Senske et al.

[11] Patent Number: 4,713,311

[45] Date of Patent: Dec. 15, 1987

[54] HOMOGENEOUS PHOTOCONDUCTIVE LAYER OF AMORPHOUS SILICON AND HYDROGEN

[75] Inventors: Wilhelm Senske, Eschborn; Roland Herkert; Norbert Marschall, both of Frankfurt; Karl-Heinrich Greeb, Dreieich, all of Fed. Rep. of Germany

[73] Assignee: Licentia Patent-Verwaltungs-GmbH, Frankfurt am Main, Fed. Rep. of Germany

[21] Appl. No.: 559,178

[22] Filed: Dec. 7, 1983

[30] Foreign Application Priority Data

Dec. 9, 1982 [DE] Fed. Rep. of Germany ..... 3245500

[51] Int. Cl.[4] ..... G03G 5/082

[52] U.S. Cl. ..... 430/127; 430/65

[58] Field of Search ..... 430/65, 66, 84, 95, 430/127, 130

[56] References Cited

U.S. PATENT DOCUMENTS

| | | | |
|---|---|---|---|
| 4,409,311 | 10/1983 | Kawamura et al. | 430/95 |
| 4,414,319 | 11/1983 | Shirai et al. | 430/95 |
| 4,461,820 | 7/1984 | Shirai et al. | 430/95 |
| 4,489,149 | 12/1984 | Kawamura et al. | 430/95 |

*Primary Examiner*—John L. Goodrow

*Attorney, Agent, or Firm*—Spencer & Frank

[57] ABSTRACT

The present invention relates to an electrophotographic recording material and to a process for manufacturing it. The material comprises an electrically conductive substrate and a photoconductive layer of amorphous silicon and hydrogen applied thereto. The recording material is characterized by only a single photoconductive layer having an oxygen component of about 1 ppm to 1 atom percent. The recording material is produced by means of cathode sputtering.

7 Claims, No Drawings

HOMOGENEOUS PHOTOCONDUCTIVE LAYER OF AMORPHOUS SILICON AND HYDROGEN

BACKGROUND OF THE INVENTION

The present invention relates to an electrophotographic recording material which contains an electrically conductive substrate and a photoconductive layer of amorphous silicon and hydrogen applied to the substrate, and to a method for producing such an electrophotographic recording material.

Amorphous silicon layers for indirect electrophotography have a mechanical hardness and heat resistance which is much greater than that of prior art record carriers. At the same time, such layers exhibit sensitivity over a broad spectrum and a level of sensitivity which, in almost the entire visible range, lies above that of materials presently employed in practice. The use of amorphous silicon leads to a significant improvement in copying machines with respect to the service life of the photoconductors and the copying speed. Moreover, amorphous silicon is a nontoxic material and thus excellently environmentally compatible.

The production of electrophotographic layers of amorphous silicon can be effected by means of two methods. In the past, production by means of a silane glow discharge has been used most frequently. In this process, the silane gas, monosilane or higher order silane, is decomposed in a high frequency plasma discharge, with an amorphous silicon hydrogen alloy being precipitated on heated substrates. The hydrogen is necessary for the realization of good electrical and optical characteristics. In order to produce electrophotographically suitable layers, it is known to add a small amount of diborane to the silane atmosphere, and possibly also oxygen. See DE-OS No. 3,117,035. This manufacturing process requires the use of highly toxic, easily flammable gases and gas mixtures. The toxicity of diborane, in particular, is expressed in its very low maximum workplace concentration value of 0.1 ppm. Although the resulting layers are no danger to health, since they are hard solid state layers, extensive and thus costly measures must be taken during the manufacturing process for handling the above-mentioned gases as well as for removing the gas mixtures discharged from the coating apparatus.

One process which does not require the use of health endangering gases, such as silane or diborane, is the cathode sputtering process. In this process, the ionized gas atoms from a noble gas plasma discharge, generally employing argon, eject particles from a solid silicon target (cathode) which precipitate in a layer on the heated substrate. The hydrogen required to realize suitable properties is mixed in with the noble gas, with the sputtering, in contradistinction to the silane glow discharge process, permitting a variation in the hydrogen content and thus in the properties of the resulting coatings. See T. D. Moustakas, *J. Electr. Mater.* 8, 391/1979.

It is known that electrophotographic record carriers of amorphous silicon can be produced with the sputtering process. However, only in multiple layer arrangements and by varying the hydrogen component as well as by including SiO bonds in one of the partial layers, as disclosed in European Pat. No. 0045204, and possibly by subsequently coating the record carrier with a covering layer will such record carriers exhibit electrophotographic usefulness.

Both manufacturing processes, sputtering and glow discharge, differ principally in the composition of their gases and in the kinetic energies of the gas molecules, which are determined by the gas pressure. Therefore, the coatings produced with these two processes also differ noticeably in their solid state characteristics, such as, for example, charge carrier mobility or hydrogen inclusion. Moreover, it cannot be expected that, for example, the doping properties in both processes are the same.

Although it is known that in the silane glow discharge process, high specific resistances can be realized by adding oxygen, (E. Holzkämpfer, J. Stuke, R. Fischer, 4th Photovoltaic Solar Energy Conference, Stresa (1982), Ed. W. H. Ploss, G. Grassi, D. Reidel Publ. Comp.), with large amounts of oxygen the spectral sensitivity range shifts in a disadvantageous manner, due to the formation of $SiO_x$, to much shorter wavelengths. With smaller amounts of added oxygen in the glow discharge process, high resistances can be realized only by adding diborane. See DE-OS No. 3,117,035. Large amounts of oxygen in the sputtering atmosphere, however, and thus proportions greater than 1 at% in the coatings, result in a decrease in resistance and thus in coatings which are unusable for electrophotographic purposes See, B. G. Yacobi, R. W. Collins, G. Moddel, P. Viktorovitch and W. Paul, Phys. Rev. B 24, 5907 (1981). Here it becomes evident how different the effects are of the same amounts of added gas in both processes. Without the addition of oxygen, only dark resistances in the range from $10^{10}$ to $10^{11}$ ohm cm could be realized by sputtering of amorphous silicon, values much too low for electrophotographic purposes. See, W. Paul in F. Yonezawa (Ed.), Fundamental Physics of Amorphous Semiconductors, Springer Series in Solid State Sciences, Volume 25 (1981), page 72 et seq.

SUMMARY OF THE INVENTION

It is an object of the present invention to provide an electrophotographic recording material of amorphous silicon which meets a number of requirements in the same manner. More particularly, it is an object of the present invention to provide such a recording material in which the electrophotographic photoconductor layer comprises a single, homogeneous layer, and in which no handling of dangerous, toxic material is necessary during manufacture. Moreover, the number of doping gases to be added is to be as low as possible. In particular, the use of compensation dopings for which handling is critical is to be avoided.

A further object of the present invention is to provide a method for manufacturing such an electrophotographic recording material.

Additional objects and advantages of the present invention will be set forth in part in the description which follows and in part will be obvious from the description or can be learned by practice of the invention. The objects and advantages are achieved by means of the processes, products, instrumentalities and combinations particularly pointed out in the appended claims.

To achieve the foregoing objects and in accordance with its purpose, the present invention provides an electrophotographic recording material comprising an electrically conductive substrate and a photoconductive layer of amorphous silicon and hydrogen applied to the substrate, wherein the material contains a single photoconductive layer having an oxygen concentration of about 1 ppm to 1 atom percent as the sole photoconductive layer in the electrophotographic recording materials.

Preferably, a material which determines the structure of the photoconductive layer is applied between the substrate and the photoconductive layer. The thickness of the structure determining layer preferably is between 0.1 and 100 nm. The structure determining layer preferably is made of $SiO_x(0.1 \leqq x \leqq 2)$, $SiC_y(0.1 \leqq y \leqq 1)$ or $SiN_z(0.1 \leqq z \leqq 1.3)$.

In one preferred embodiment of the invention, an intermediate layer is disposed between the substrate and the photoconductive layer for blocking the carrier injection.

The present invention also provides a process for producing an electrophotographic recording material having an electrically conductive substrate and a photoconductive layer of amorphous silicon and hydrogen applied to the substrate, wherein the cathode sputtering process having a sputtering atmosphere of argon and hydrogen is employed to apply the photoconductive layer of amorphous silicon and hydrogen as the sole photoconductive layer in the electrophotographic recording material, and a proportion of about 1 ppm to 1 volume percent oxygen or oxygen releasing gas are added to the sputtering atmosphere of argon and hydrogen to provide an oxygen concentration in the range of about 1 ppm to 1 atom percent in the photoconductive layer.

Preferably, an oxygen component of about 1 ppm to 50 volume percent is added only at the beginning of the growth process until a structure determining layer thickness of about 0.1 to 100 nm is reached.

In one embodiment of a process for producing an electrophotographic recording material having an electrically conductive substrate and a photoconductive layer of amorphous silicon and hydrogen applied to the substrate, the cathode sputtering process having a sputtering atmosphere of argon and hydrogen is employed to apply the photoconductive layer of amorphous silicon and hydrogen as the sole photoconductive layer in the electrophotographic recording material, the sole photoconductive layer having an oxygen concentration of about 1 ppm to 1 atom percent, and for the structure determining layer a proportion of about 1 ppm to 50 volume percent nitrogen releasing and/or carbon releasing gas is added to the sputtering atmosphere of argon and hydrogen at the beginning of the growth process until a layer thickness of about 0.1 to 100 nm is reached.

It is to be understood that both the foregoing general description and the following detailed description are exemplary and explanatory, but are not restrictive of the invention.

DETAILED DESCRIPTION OF THE INVENTION

Surprisingly, it has been found that it is possible in the sputtering process, without the use of compensatingly acting doping gases and with the addition of only the lowest oxygen concentrations, to realize resistances far above $10^{12}$ Ohm cm and thus obtain homogeneous amorphous silicon layers which are suitable for electrophotographic purposes. The oxygen addition range lies between about 1 ppm and a maximum of 1 atom percent preferably between 1 and 100 ppm. Such small quantities of $O_2$ are sufficient in the sputtering process to greatly reduce the dark conductivity in that presumably the oxygen atoms contribute to the saturation of free valences of the Si atoms and thus reduce the electronic state density in the band gap. At the same time, the addition of oxygen in the ppm range presumably creates traps which reduce charge transport in the dark. Trap concentrations of at least $10^{16}$ to $10^{17}$ $cm^{-3}$ are necessary for the electrophotographic chargeability of a material so as to reduce the charge carrier injection on the part of the substrate even without a blocking layer. Such trap concentrations can be developed by accurately setting the manufacturing conditions, such as the argon/hydrogen ratio between 1/0.03 and 1/0.5, substrate temperature between 100° and 300° C., flow rate between 0.2 and 100 standard cubic centimeters per minute and an addition of oxygen in the amount of a few ppm. However, the trap concentration must not be too high, that is at maximum about $10^{19}$ $cm^{-3}$, since otherwise the mobility of the charge carriers and thus the photosensitivity of the layers becomes uselessly low. This is what determines the upper limit of the amount of oxygen to be added. The same effect as realized from the addition of oxygen can be realized by the addition of gases which release oxygen, for example laughing gas, $N_2O$ for the photoconductive layer.

Examples for gases that release nitrogen or carbon for the fabrication of the structure determining layer are nitrogen trihydride ($NH_3$) or methane ($CH_4$).

The advantages realized by the present invention are, in particular, that the amorphous silicon can be produced for use in electrophotography in a process which does not require the use of any toxic or self-combustive gases. This permits the omission of complicated and at the same time cost intensive measures for the handling of toxic gases and for the elimination of gases discharged by the pumps. The image carriers may be applied as homogeneous layers, with no blocking layer being required. No gases other than hydrogen and oxygen need be added. A compensation for residual conductivity by the addition of diborane can be omitted. Record carriers produced in this manner exhibit charge field intensities of more than 40 V/μm. The sputtering process, operated with high frequency or direct voltage, permits high growth rates, particularly when using a magnetron sputtering process. Thus, this process offers advantageous conditions for use in industrial production.

In a preferred embodiment of the present invention, an intermediate layer of, for example, $SiO_2$, $Al_2O_3$, $CeO_2$, is introduced between the photoconductor and the substrate to provide a better injection blockage. The thickness of the blocking layer is suitably selected to be between 5 and 500 nm. This makes it possible to increase the charging limit to more than 60 V/μm with a positive charge and a simultaneous reduction of dark discharges.

A layer which determines the structure of the subsequently applied photoconductive layer may also be applied to the substrate, if required. In this way it is possible to produce a high trap concentration, particularly at the interface with the substrate, to prevent the injection of charge charriers into the photoconductive layer due to the build-up of stationary space discharges. The function of structure determining layers cannot be compared with that of a blocking layer. Blocking layers are active elements which serve the purpose of preventing the injection of charge carriers from the substrate into the photoconductor. To be able to perform such a function, they must have a sufficient thickness so that the charges accumulating at the interfaces are prevented from passing through even in small quantities. Structure determining layers, e.g. those of $SiO_x$, $SiC_x$ or $SiN_x$, however, may be effective already in thicknesses of a few nm since they are intended merely to produce a bond configuration which results in high trap concentrations in the photoconductive layer.

The following examples are given by way of illustration to further explain the principles of the invention. These examples are merely illustrative and are not to be understood as limiting the scope and underlying principles of the invention in any way.

EXAMPLE 1 FOR AN ELECTROPHOTOGRAPHIC RECORDING MATERIAL

A photoconductive amorphous silicon layer is produced at a substrate temperature of 250° C. with a power density of about 1 $W/cm^2$ in argon with 30 Vol% hydrogen, a gas flowthrough of 20 standard cubic centimeters per minute, a pressure of 10 mTorr and an oxygen concentration of less than 10 ppm. This layer has a charge level of 44 V/μm.

EXAMPLE 2

A layer combination with blocking layer, with an amorphous silicon photoconductor layer having the above-mentioned data of Example 1 is employed. An $Al_2O_3$ layer of a thickness of 1000 Å is applied as an injection blocking layer on the conductive substrate. The layer combination has a charge level of 74 V/μm. With a photoconductive layer thickness of about 2.5 μm, the electrophotographically measured photosensitivity of this photoconductive layer, between 400 and 500 nm, reaches the maximum possible photoelectric gain of 1, and by increasing the layer thickness, the high spectral sensitivity can be expanded to the entire visible range.

It will be understood that the above description of the present invention is susceptible to various modifications, changes and adaptations, and the same are intended to be comprehended within the meaning and range of equivalents of the appended claims.

What is claimed is:

1. A process for producing an electrophotographic recording material having an electrically conductive substrate and an homogeneous photoconductive layer of amorphous silicon and hydrogen applied thereon, said process comprising precipitating a photoconductive layer of silicon onto a substrate maintained at a temperature ranging from 100° to 300° C. by cathode sputtering in an atmosphere consisting of oxygen or an oxygen-releasing gas, hydrogen and argon, wherein the oxygen or oxygen-releasing gas is present in a proportion of about 1 ppm to 1 vol.% to said hydrogen and said argon gases.

2. The process of claim 1, further comprising precipitating a structure-determining layer of silicon on the substrate prior to depositing the photoconductive layer, said structure-determining layer having a thickness of about 0.1 nm to 100 nm and being deposited in an atmosphere containing hydrogen, argon and oxygen gases, said oxygen gas being added to said hydrogen and said argon gases in an amount of about 1 ppm to 50 vol.%.

3. The process of claim 1, further comprising precipitating a structure-determining layer of silicon on the substrate prior to depositing the photoconductive layer, said structure-determining layer having a thickness of about 0.1 nm to 100 nm and being deposited in an atmosphere containing hydrogen, argon and a carbon- or nitrogen-releasing gas, said carbon- or nitrogen-releasing gas being added to said hydrogen and said argon gases in a proportion of about 0.1 ppm to 50 vol.%.

4. The process of claim 1, wherein the proportion of said oxygen gas in the atmosphere is maintained constant throughout the process.

5. The process of claim 1, wherein said silicon layer contains oxygen atoms which are homogeneously distributed throughout the thickness of the silicon layer.

6. The process of claim 1, wherein said silicon layer is the sole photoconductive layer of the electrophotographic recording material.

7. The process of claim 1, wherein said silicon is amorphous silicon.

* * * * *